US005437454A

United States Patent [19]

Friedman

[11] Patent Number: 5,437,454

[45] Date of Patent: Aug. 1, 1995

[54] RECIPROCATING MANIPULABLE BALL PUZZLE

[75] Inventor: Ira Friedman, West Palm Beach, Fla.

[73] Assignee: Tri-Tec Industries Ltd., West Palm Beach, Fla.

[21] Appl. No.: 235,697

[22] Filed: Apr. 29, 1994

[51] Int. Cl.[6] ..... A63F 9/08

[52] U.S. Cl. ..... 273/153 S; 273/109; 273/117

[58] Field of Search ..... 273/264, 271, 153 R, 273/157 A, 153 S, 108, 109, 113, 115, 117, 118 R, 123 R

[56] References Cited

U.S. PATENT DOCUMENTS

| | | | |
|---|---|---|---|
| 2,419,000 | 4/1947 | Ashwood . | |
| 3,601,404 | 8/1971 | Weisbacker . | |
| 3,709,497 | 1/1973 | Barlow . | |
| 3,731,934 | 5/1973 | Shoptaugh . | |
| 3,820,793 | 6/1974 | Palmer . | |
| 4,234,185 | 11/1980 | Alsip . | |
| 4,402,510 | 9/1983 | Yokoi | 273/153 S |
| 4,482,154 | 11/1984 | Mizunuma et al. | 273/153 S |
| 4,541,635 | 9/1985 | Shoptaugh . | |
| 4,542,904 | 9/1985 | Parlato . | |
| 4,813,679 | 3/1989 | Hoffman . | |

FOREIGN PATENT DOCUMENTS

| | | | |
|---|---|---|---|
| 1186351 | 4/1985 | Canada | 273/153 S |

*Primary Examiner*—V. Millin
*Assistant Examiner*—William M. Pierce
*Attorney, Agent, or Firm*—Beveridge, DeGrandi, Weilacher & Young

[57] ABSTRACT

A manipulable puzzle and method includes a shallow box-like housing with a see-through top established by base-conforming side walls and-apertured front and back walls for containing slider bars incorporating a plurality of alternating teeth and pockets which are translated relative to the housing for selective manipulation of color coded balls between the pockets of adjacent, aligned slider bars to establish new distribution patterns of the color coded balls.

13 Claims, 4 Drawing Sheets

FIG. 8
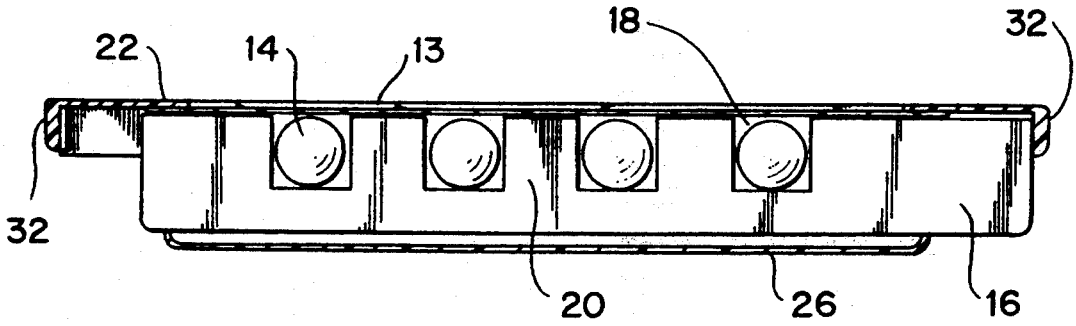
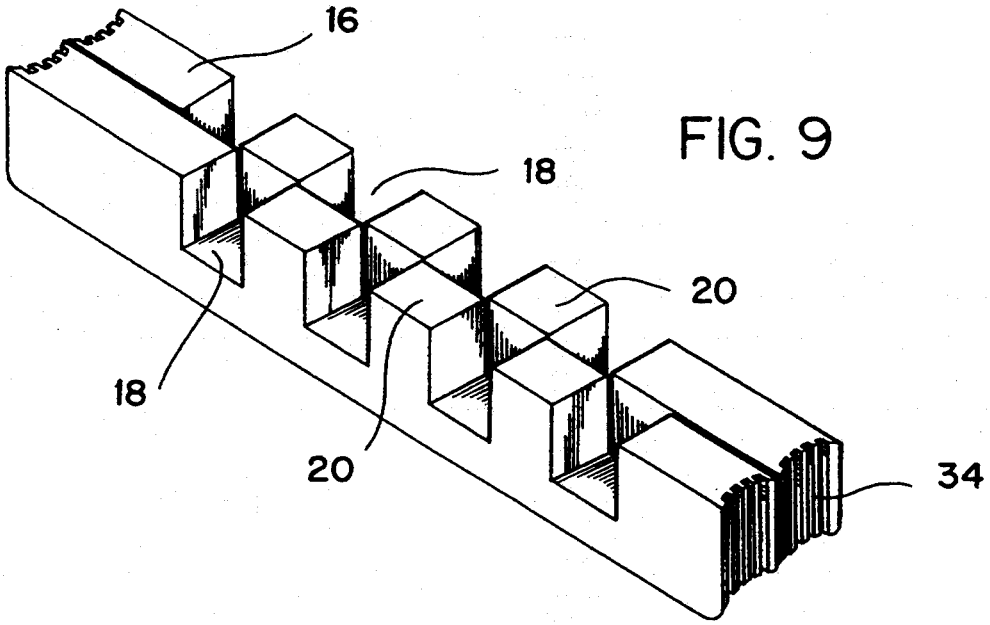
FIG. 9

RECIPROCATING MANIPULABLE BALL PUZZLE

TECHNICAL FIELD

The present invention is directed to an amusement device and more particularly, to a self-contained, manipulable ball puzzle of the type with multiple color coded balls, a frame, and a plurality of translatable, pocketed, slider members which are adapted for selective communication of the color coded balls between adjacent slider pockets. By moving and sequentially displacing selected balls, the balls can establish a predetermined pattern within the pockets of the slider members.

BACKGROUND OF THE INVENTION

Puzzles and particularly integral, neatly packaged, multi-piece manipulable puzzles are popular for recreation and amusement. The interest for new and mentally challenging manipulable ("brainteaser") puzzles continues to grow, even in the face of the ubiquitous and increasingly sophisticated electronic amusement devices. "Brainteaser" inventions naturally augment recreation yet allow relaxed thoughtful self-improvement. A very popular form of manipulable puzzles is the portable and self-contained type which provides the user to define the desired level of activity and interruption without necessarily disrupting the user's progress. Also such puzzles foster collateral benefits such as promoting analytical thinking by requiring the user to predict the result of each particular manipulation as well as some enhancement of hand-eye coordination.

SUMMARY OF THE INVENTION

It is an object of the present invention to provide the advantages of an novel, manipulable puzzle for amusement and entertainment.

It is another object of this invention to provide a manipulable puzzle presenting differing degrees of difficulty.

Another object of this invention is to provide a manipulable puzzle which has a multiplicity of solutions.

Other objects of this invention are to provide a puzzle which is at once attractive and challenging.

Still further objects of this invention is to provide a unitary, self-contained puzzle.

These and other objects are satisfied by a puzzle type amusement device, comprising:

a plurality of movable pieces;

a housing with a generally planar top member, a generally planar bottom member, two oppositely disposed and spaced apart front and back wall members connecting said top and bottom members where said top, bottom and wall members define a box having generally rectangularly side apertures; and at least two translatable and alignable slider bar members contained by said housing, said slider bar members having alternating pockets and teeth, each one of said pockets being dimensioned to receive one of said movable pieces and each one of said pockets being capable of communication of said movable piece to a pocket of an adjacent slider bar member when aligned, where each of said slider bar members extends through said respective side apertures and where each is translatable both relative to an immediately adjacent slide bar member and relative to said housing.

Certain objects of the invention are satisfied by a method of using a manipulative puzzle including a plurality of movable pieces contained by at least two translatable slider bar members having alternating pockets and teeth, where each one of the pockets is dimensioned to receive one of said movable pieces and which is alignable with pockets of an adjacent slider bar member, a generally shallow rectangular housing for containing the slider bar members and permitting translation of the slider bar members relative thereto, the method comprising the steps of:

translating a respective slider bar relative to the housing to align a pocket of the translated slider bar member with a pocket of a second slider bar member;

communicating a movable pieces from the pocket of one slider bar member to the aligned pocket of the second slider bar member; and establishing a new pattern of the movable pieces relative to the housing and the slider bar members.

Given the following enabling description of the drawings, the scope of the subject puzzle game invention should become evident to a person of ordinary skill in the art.

BRIEF DESCRIPTION OF THE DRAWINGS

FIG. 8 is cutaway side view along line 8—8 in FIG. 1.

FIG. 9 is a perspective view of two adjacent pocketed, slider bars according to the invention.

DETAILED DESCRIPTION OF THE PREFERRED EMBODIMENT

Figure 1:
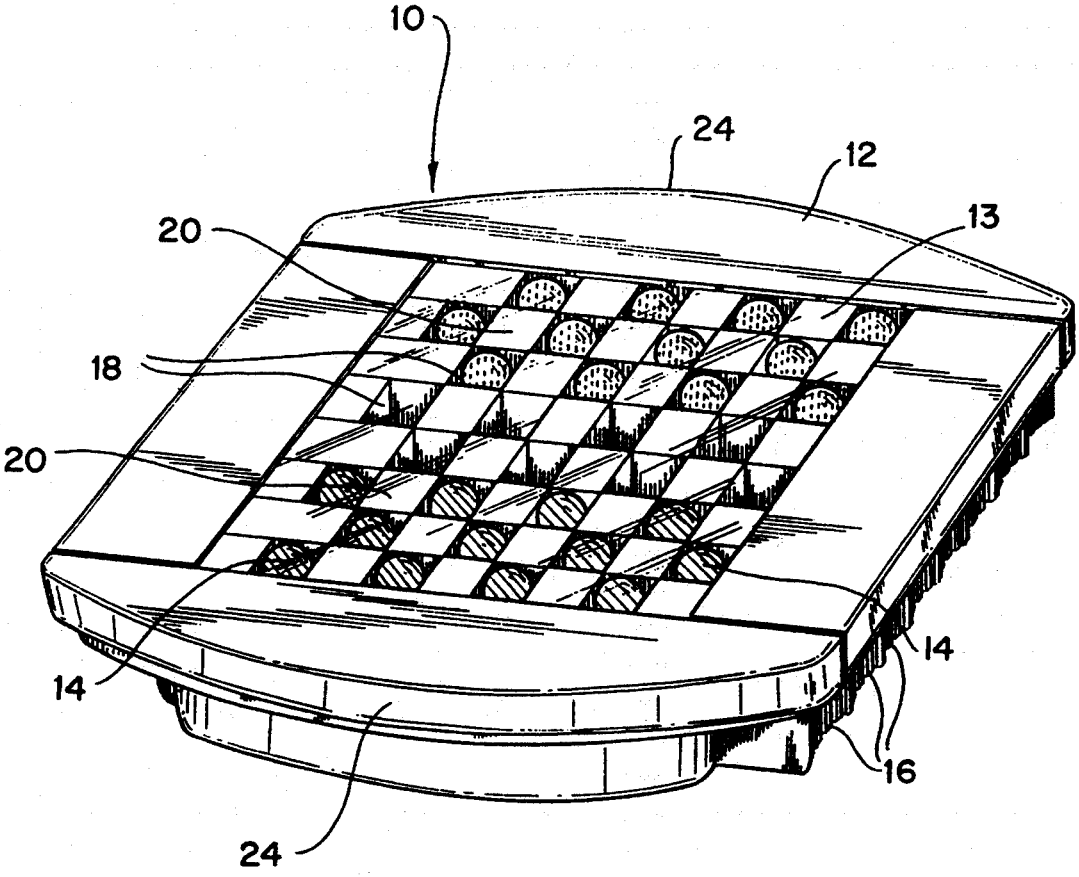
FIG. 1 is a perspective view of an embodiment of a manipulable puzzle device according to the invention.

FIGS. 1–7 depict an embodiment of a puzzle 10 according to the invention. FIG. 8 is a crossection of the depicted embodiment in FIGS. 1–7 and FIG. 9 is a detail of the slider bars used in the invention.

In overview, the puzzle invention 10 comprises a frame 12 with a clear top panel 13 to permit visual access to the underlying color coded balls 14. The balls 14 are each lodged in a complementarily dimensioned pockets/opening 18 of parallelly aligned, slider bars 16. The slider bars 16 are slidably mounted within the frame 12 to translate within the frame 12. Also each slider bar 16 is mounted independently of the adjacent slider bar so that each can translate relative to one another. Each slider bar 16 includes teeth or barriers 20 alternating between the pockets/openings 18. By translating the slider bars 16, the user can selectively move balls between openings in adjacent slider bars to achieve distribution of the balls in a desired pattern.

In more detail and referring specifically to the illustrated embodiment of FIGS. 1–7, the invention is a manipulable game puzzle 10 with a housing/frame 12.

The frame 12 defines a generally shallow, rectangular box and which is dimensioned to be hand-held by the user. The frame 12 is preferably formed from a rugged molded thermoplastic material such as high impact styrene 100 mil (or thicker) and fabricated by conventional thermoplastic molding techniques such as injection molding or vacuum thermo-forming.

The top 22 of frame 12 is generally planar and rectangular but with somewhat bowed front and back peripheral edges 24. The frame 12 houses a plurality of slidably mounted, contiguous, translatable, complementary slider bars 16 and has inset therein a generally square transparent plastic top or clear plate 13. The clear plate 13 can be glued or thermoset into the top 22 and is intended to be integral with and generally centered within the top 22. The function of the clear top plate 13 is two fold. First it allows for viewing of the underlying colored balls in the "playing field" established the slider bars 16 and frame 12. Secondly, the top plate 13 serves to confine the balls within the "playing field" regardless of the frame 12 being tilted or even inverted.

The bottom of the frame 12 is defined by a generally rectangular and planar molded plastic bottom plate 26 (see FIG. 3) which defines a smaller peripheral "footprint" than the periphery of the top 22. As illustrated in FIGS. 4 through 7, the top plate 22 and the bottom plate 26 are connected together by the front wall 28 and the back wall 30. The front wall 28 and the back wall 30 preferably do not include potentially injurious sharp edges and are curved or bowed outwardly. The walls 28 and 30 have a width (depth) of somewhat more than the diameter of a ball 14 and establish the shallow box-like structure of the frame 12 along with the top plate 22 and the bottom plate 26.

The sides of the frame 12 essentially comprise rectangular openings. The openings define an inner periphery which corresponds to the cross-sectional perimeter of the eight generally co-planar slider bars 16 arranged side-by-side. The eight finger slider bars 16 are slidably mounted within and register with the periphery of the opening. In the illustrated embodiment, the openings are centered relative to the front and back walls 28 and 30 and the top and bottom plates 22 and 26.

Figure 3:
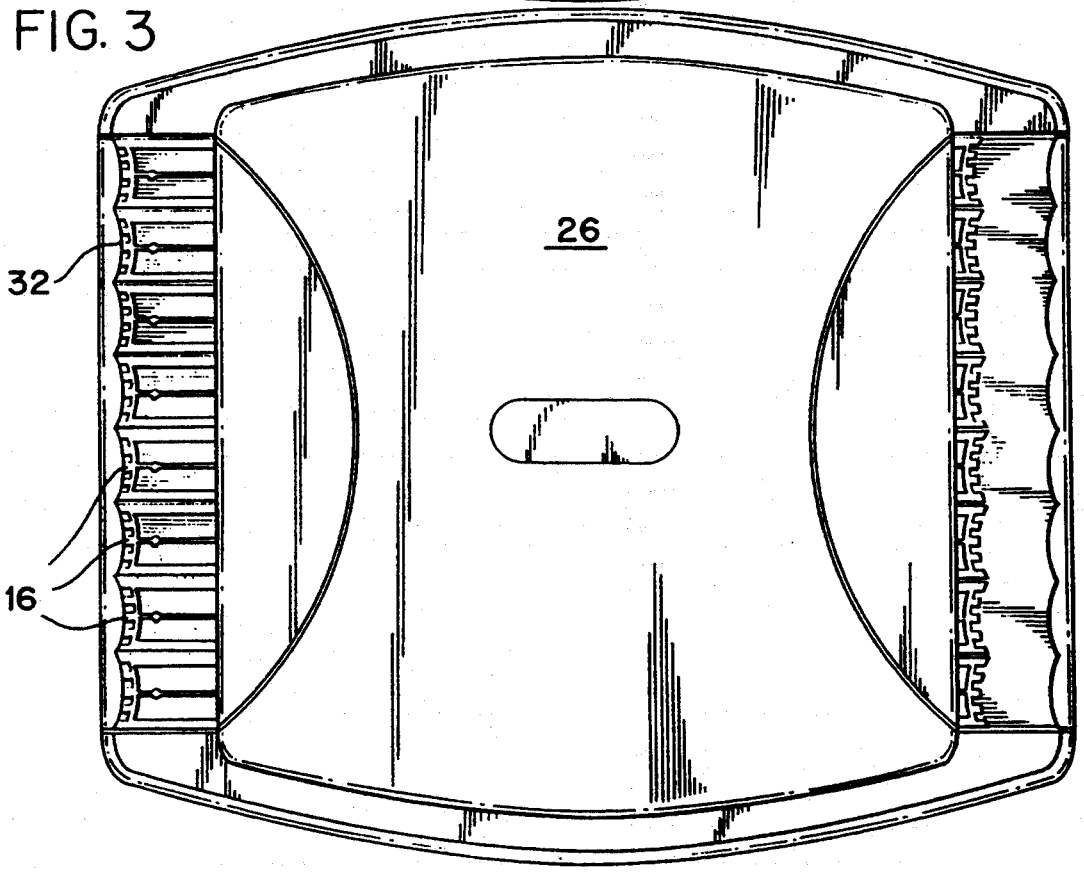
FIG. 3 is a bottom view of the embodiment of FIG. 1.
Figure 4:
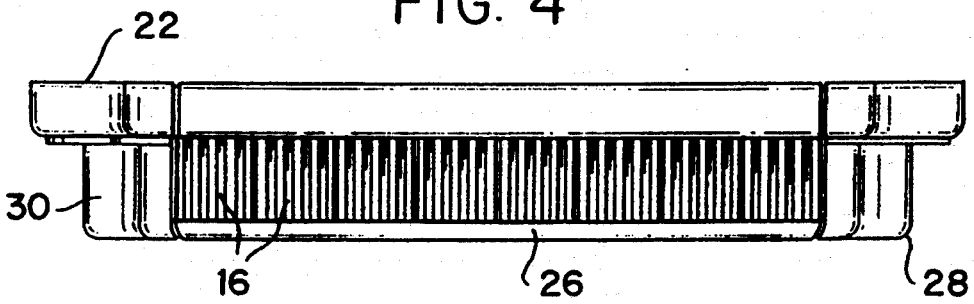
FIG. 4 is a first side view of the embodiment of FIG. 1.
Figure 5:
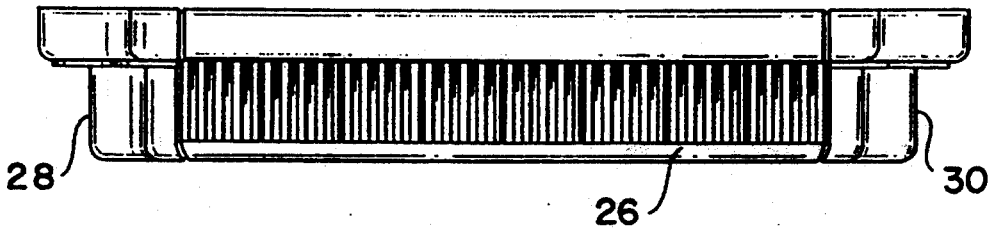
FIG. 5 is a second, opposite side view of the embodiment of FIG. 1.
Figure 6:
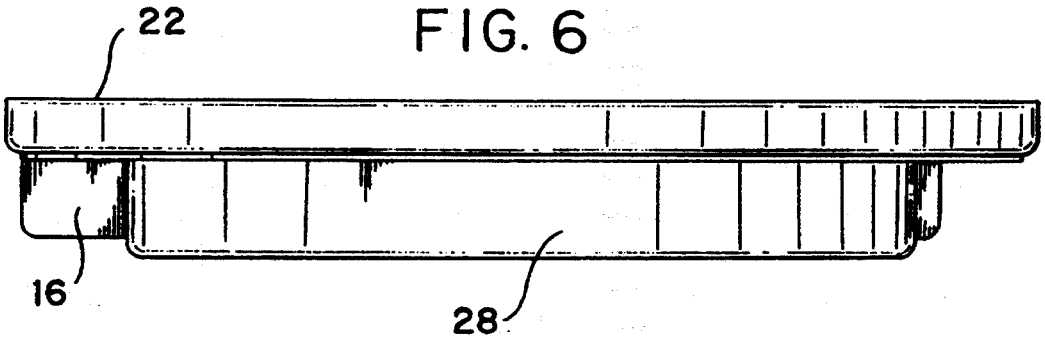
FIG. 6 is a front view of the embodiment of FIG. 1.
Figure 7:
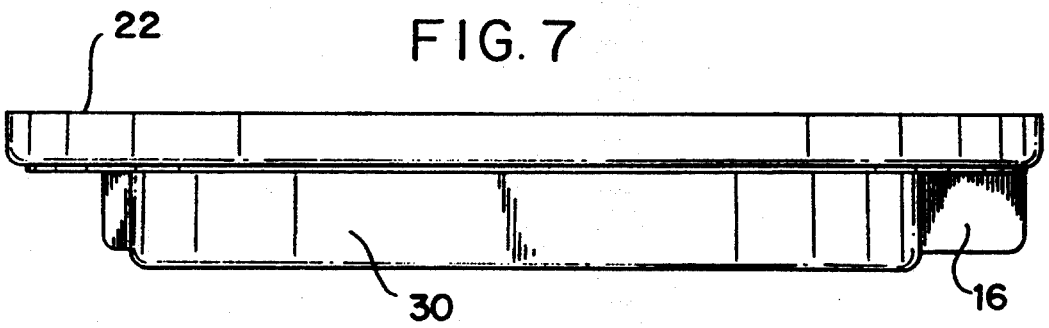
FIG. 7 is a rear view of the embodiment of FIG. 1.

In the illustrated embodiment, the amount of reciprocating translation of the slider bars 16 within the openings is limited by a stop lip 32 (See FIGS. 3 and 8). The stop lip 32 depends from the bottom side edges of the top plate 22. The stop lip 32, as illustrated, includes a scalloped profile which is provided to conform to the curvature of the end faces 34 of the finger slider bars 16. The particular configuration of the stop lip 32 is not critical so long as a structure is provided which serves two functions. In the illustrated embodiment, the stop lip 32 both confines the translational movement of each individual slider bar 16 and provides a convenient gauge for alignment of the openings 18 of adjacent slider bars for transfer of balls 14 therebetween.

The ball or marble-like pieces 14 are the targets of manipulation in the inventive puzzle. Although other shapes, e.g. compact, generally spherical shapes, e.g. animals, can be used, preferably the pieces are spherical colored balls or marbles. In the illustrated embodiment, there are 24 balls 14 divided into two sets of twelve. Each of the two sets of balls has a different color, e.g., purple and green and the two sets of balls 14 are distributed in the thirty-two openings 18. As a result of the illustrated arrangement, the puzzle 10 has a total of twenty-four occupied pocket openings 18 and eight vacant pockets to permit transfer/manipulation of the balls. It should be readily apparent that the invention is not limited to the described 24:32 ratio of the number of balls to open pockets or to using two sets of balls 14.

The slider bars 16 in which the balls nest, preferably have a square tooth profile to provide a checkerboard-type appearance when viewed through panel 13. The openings 18 and the teeth 20 have a length, width, and height substantially equal to or just slightly larger than the diameter of the balls 14. The preferred square-toothed, parallel relationship between adjacent slider bars 16 is depicted in FIG. 9.

As is also clear in FIG. 9, each slider bar 16 has curved end faces 34. The curved faces 34 facilitate tactile sensing and reciprocation of an individual slider bar 16 between the stop lips 32. Also, in the preferred embodiment, the curvature of the end face 34 and the scalloping of the stop lip 32 are complementary and provide for precise alignment between adjacent slider bars 16 for transfer of the balls 14 therebetween.

The terminal "teeth", those containing end faces 34, have a double length. That is, each is about two ball diameters long. Also, as represented in FIG. 1, the pockets/openings/cavities 18 of adjacent slider bars 16 are offset when the end faces 34 are aligned. Thus, a cavity 18 of a select slider bar 16 is staggered relative to a cavity of and aligned relative to a square tooth or barrier 20 of the adjacent slider bar.

As a result of the structure of the frame 12, as depicted in cross-section in FIG. 8, movement of the slider bars 16 permits selective movement of the balls 14 within the "playing field" which is located under and defined by the clear top panel 13. The movement of a slidably mounted slider bar 16 is governed by the user placing a finger on and pushing against the curved end face 34. The degree of translation of the slider bar 16, however, is limited by stop lip 32. The illustrated embodiment contains a convenient slider bar 16 translation limit equivalent to the diameter of one ball 14 (also the length of the pocket 18).

Figure 2:
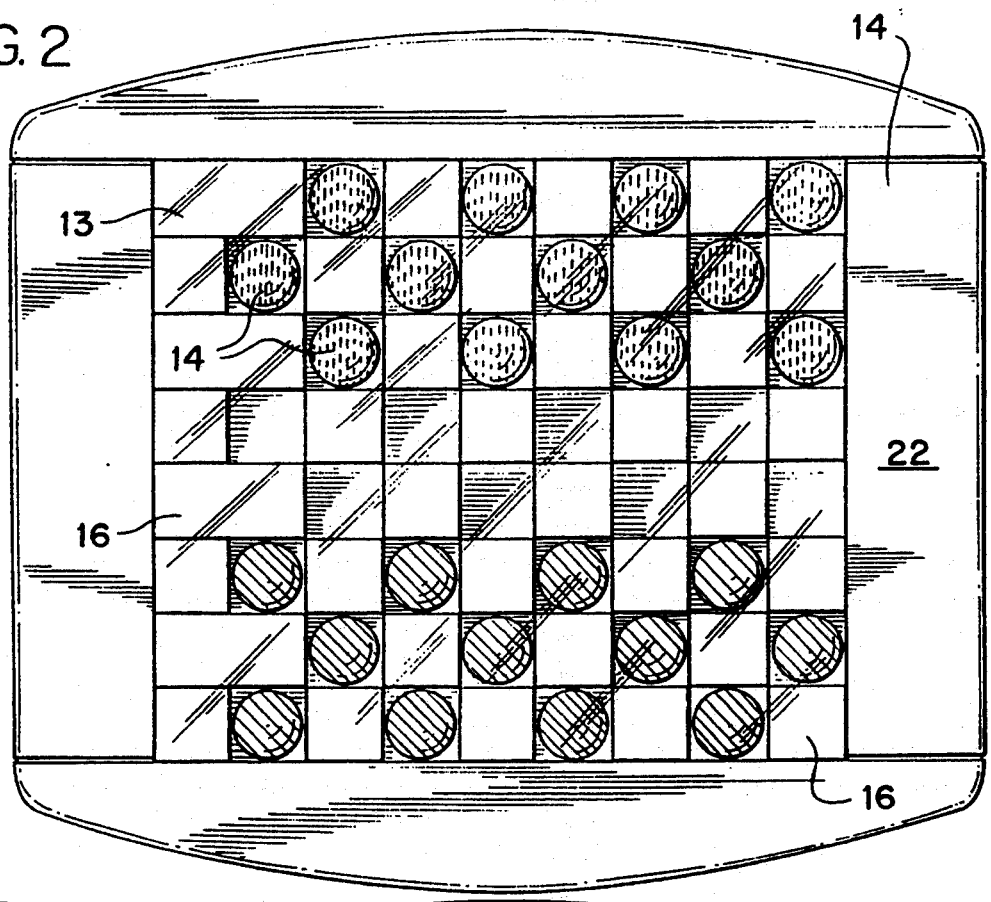
FIG. 2 is a top view of the embodiment depicted in FIG. 1.

The slider bars can be aligned or staggered relative to one another. For example, as illustrated in FIGS. 1 and 2, when all of the end faces 34 are brought into contact with the stop lip 32 on one side, the slider bars 16 form an 8 by 8 checkerboard pattern. This pattern is altered during manipulation of the balls 14 in order to obtain redistribution thereof in a the desired pattern.

The method of use or manipulation of the puzzle 10 should be apparent from the foregoing. During "play", e.g., manipulation of the balls through the pattern/"-playing field", the user uses finger pressure to translate a selected slider bar 16 within the frame 12 to move the pockets 18 in and out of alignment with the pockets 18 of an adjacent slider bar 16. Once aligned, the user can tilt the frame so that the balls or selected ball 14 move from one pocket to the next under the influence of gravity. By selective manipulation of this type, the balls may be sequentially displaced or re-distributed within the "playing field" to achieve a selected pattern.

By shifting the slider bars and tilting the puzzle 10, the position of the colored balls 16 can be manipulated into new positions and ultimately can form a new selected pattern. The user places a finger on a selected slide end face and translates that slider bar to the left or right by one ball width relative to the frame so as to align the pockets. The user can then maintain or displace the balls from one slider bar to the other. By maintaining selected balls in one slider bar and displacing other balls to another slider member, the process of shifting the slide members and displacing selected balls permits development of new patterns. Such new patterns result from the selective positioning by manipulation of the colored balls. The objective of one form of use of the invention is to move the balls from one pattern to another preselected pattern. In one arrangement essentially opposite the above-mentioned checkerboard pattern, the pockets/openings 18 of all eight slider bars 16 can be aligned to form a continuous channel from front to back and the balls 14 of the two sets can distributed within those channels.

Given the foregoing, variations and modifications to the invention should now be apparent to a person having ordinary skill in the art. The specific dimensions of the frame and of the respective structural features will be governed by the specific puzzle construct and need not be of particular significance so long as they adhere to the functional principals described above. Other potential variations include the number of slider bars and number of pockets/openings therein. The particular geometry and arrangement of the frame, the window, the slider bars, etc. can be modified without departing from the scope of this invention. For example, the slider bar teeth, can be conically or pyramidally shaped and each ball can be uniquely color coded. These variations and other modifications are intended to fall within the scope and spirit of the invention as defined by the following claims.

I claim:

1. An puzzle type amusement device, comprising:

a plurality of movable pieces;

a housing with a generally planar top member, a generally planar bottom member, two oppositely disposed and spaced apart front and back wall members connecting said top and bottom members where said top, bottom and wall members define a box having generally rectangularly side apertures; and at least two slider bar members contained by said housing, the at least two slider bar members being contiguous and movable relative to each other and the housing and alignable relative to each other, each of said slider bar members having alternating pockets and teeth, each one of said pockets being dimensioned to receive one of said movable pieces and each one of said pockets being capable of communication of said movable piece to a pocket of said other of the at least two contiguous slider bar members when said pockets of the adjacent slider bar members are aligned, where each of said slider bar members extends through said respective side apertures, and where each is translatable both relative to an immediately adjacent slide bar member and relative to said housing.

2. A puzzle type amusement device according to claim 1 which is hand held and where the movable pieces are color coded balls and the teeth and pockets of the slider bar members are generally cubic having dimensions corresponding to the diameter of the color coded balls.

3. A puzzle type amusement device according to claim 1 where the housing has a clear top panel formed in said top member and said top member includes a depending stop lip to limit the movement of said slider bar members.

4. A puzzle type amusement device, comprising:

a plurality of movable pieces;

a housing with a generally planar top member, a generally planar bottom member, two oppositely disposed and spaced apart front and back wall members connecting said top and bottom members where said top, bottom and wall members define a box having generally rectangularly side apertures and where the housing has a clear top panel formed in said top member; and eight, parallel, co-planar, translatable and alignable slider bar members contained by said housing, said slider bar members having alternating pockets and teeth, each one of said pockets being dimensioned to receive one of said movable pieces and each one of said pockets being capable of communication of said movable piece to a pocket of an adjacent slider bar member when aligned, where each of said slider bar members extends through said respective side apertures and where each is translatable both relative to an immediately adjacent slide bar member and relative to said housing between an alternating checkerboard pattern and an aligned column pattern;

where said top member includes a depending stop lip to limit the movement of said slider bar members.

5. A puzzle type amusement device according to claim 4 where said box is generally shallow and rectangular and six sided said slider bar members are translatable between the stop lips a selected distance generally equal to about the two diameters of said color coded balls.

6. An amusement puzzle of the manipulation type, comprising: a frame, at least one movable puzzle piece, at least two finger actuable, elongated translatable members slidably mounted within the frame and contiguous with one another, each of said translatable members including at least one tooth and at least one pocket adapted for receiving said at least one puzzle piece, said translatable members being relatively translatable to permit said pockets of contiguous members to be aligned for communication of said movable puzzle piece directly between said pockets of said at least two contiguous elongated translatable members to the other.

7. An amusement puzzle device according to claim 6 where said frame has generally planar top member, a generally planar bottom member, two oppositely disposed and spaced apart front and back wall members connecting said top and bottom members where said top, bottom and wall members defining generally rectangularly side apertures.

8. An amusement puzzle device according to claim 7 where the movable pieces are color coded balls and the translatable members each include a plurality of teeth and pockets which are generally cubically dimensioned corresponding to the diameter of the color coded balls.

9. An amusement puzzle of the manipulation type, comprising:

a frame, at least one movable puzzle piece, at least eight finger actuable, elongated translatable members slidably mounted within the frame, each of said translatable members including at least one pocket adapted for receiving said at least one puzzle piece, said translatable members being relatively translatable to permit said pockets to be aligned for communication of said movable puzzle piece to become between said pockets;

where said frame has generally planar top member, a generally planar bottom member, two oppositely disposed and spaced apart front and back wall members connecting said top and bottom members where said top, bottom and wall members defining generally rectangularly side apertures, and where the movable pieces are color coded balls and the translatable members each include a plurality of teeth and pockets which are generally cubically dimensioned corresponding to the diameter of the color coded balls.

10. A method of using a manipulative puzzle including a plurality of movable pieces contained by at least two translatable slider bar members contiguous with and alignable with one another having alternating pockets and teeth, for direct communication of at least one movable piece from one of the at least two translatable slider bar members to the other slider bar member, where each one of the pockets is dimensioned to receive one of said movable pieces and which is alignable with pockets of an adjacent slider bar member, a generally shallow rectangular housing for containing the slider bar members and permitting translation of the slider bar members relative thereto and relative to one another, the method comprising the steps of:

translating a respective slider bar relative to the housing to align a pocket of the translated slider bar member with a pocket of a second, contiguous slider bar member;

communicating a movable pieces from the pocket of one slider bar member to the aligned pocket of the contiguous second slider bar member; and establishing a new pattern of the movable pieces relative to the housing and the slider bar members.

11. A method according to claim 10 where the movable pieces are two sets of color coded balls and where the new pattern is established by re-distributing the balls relative to the housing.

12. A method of using a manipulative puzzle including a frame, at least one movable puzzle piece, at least eight finger actuable, elongated translatable members slidably mounted within the frame, each of the translatable members including at least one pocket adapted for receiving the at least one puzzle piece, the translatable members being relatively translatable to permit the pockets to be aligned for communication of the movable puzzle piece between the pockets, and where the frame has generally planar top member, a generally planar bottom member, two oppositely disposed and spaced apart front and back wall members connecting said top and bottom members where the top, bottom and wall members define generally rectangularly side apertures, and where the movable pieces are color coded balls and the translatable members each include a plurality of teeth and pockets which are generally cubically dimensioned corresponding to the diameter of the color coded balls, the method comprising the steps of:

translating a respective slider bar relative to the housing to align a pocket of the translated slider bar member with a pocket of a second slider bar member;

communicating a movable pieces from the pocket of one slider bar member to the aligned pocket of the second slider bar member; and establishing a new pattern of the movable pieces relative to the housing and the slider bar members.

13. A method of using a manipulative puzzle including a frame, at least one movable puzzle piece, at least two finger actuable, elongated translatable members slidably mounted within the frame and contiguous with one another, each of the translatable members including at least one pocket adapted for receiving the at least one puzzle piece, the translatable members being relatively translatable to permit the pockets to be aligned for communication of the movable puzzle piece between the pockets, and where the frame has generally planar top member, a generally planar bottom member, two oppositely disposed and spaced apart front and back wall members connecting said top and bottom members where the top, bottom and wall members define generally rectangularly side apertures, and where the movable pieces are color coded balls and the translatable members each include a plurality of teeth and pockets which are generally cubically dimensioned corresponding to the diameter of the color coded balls, the method comprising the steps of:

translating a respective slider bar relative to the housing to align a pocket of the translated slider bar member with a pocket of the contiguous second slider bar member;

communicating a movable pieces from the pocket of the slider bar member to the aligned pocket of the contiguous second slider bar member; and establishing a new pattern of the movable pieces relative to the housing and the slider bar members.

* * * * *